US006530180B2

(12) United States Patent
Edmondson et al.

(10) Patent No.: US 6,530,180 B2
(45) Date of Patent: Mar. 11, 2003

(54) FRAMING LAYOUT TEMPLATE

(76) Inventors: Ben C. Edmondson, 1972 San Luis Dr., San Luis Obispo, CA (US) 93401; James K. Edmondson, 479 Merritt Ave., Apt. A, Oakland, CA (US) 94610

( * ) Notice: Subject to any disclaimer, the term of this patent is extended or adjusted under 35 U.S.C. 154(b) by 55 days.

(21) Appl. No.: 09/769,928

(22) Filed: Jan. 24, 2001

(65) Prior Publication Data

US 2002/0095906 A1 Jul. 25, 2002

(51) Int. Cl.[7] ..... E04B 1/00

(52) U.S. Cl. ..... 52/105; 52/745.1; 52/653.1; 52/733.2; 33/758; 33/760

(58) Field of Search ..... 52/105, 653.1, 52/656.9, 733.2, 733.3, 475.1, 745.1, 481.1, 745.2, 779; 33/613, 645, 755, 758, 562, 760; 269/904, 910; 428/343

(56) References Cited

U.S. PATENT DOCUMENTS

| | | | | |
|---|---|---|---|---|
| 2,187,087 A | | 1/1940 | Leary | |
| 2,567,586 A | | 9/1951 | Werder | |
| 2,575,595 A | | 11/1951 | Rienecker | |
| 2,686,959 A | | 8/1954 | Robinson | |
| 2,744,334 A | | 5/1956 | Jondole | |
| 3,201,874 A | | 8/1965 | Christy | |
| 3,922,464 A | | 11/1975 | Silver et al. | |
| 4,301,596 A | | 11/1981 | Sedlock | |
| 4,625,415 A | | 12/1986 | Diamontis | |
| 4,843,726 A | | 7/1989 | Ward | |
| 4,845,858 A | | 7/1989 | Thomas | |
| 4,958,814 A | | 9/1990 | Johnson | |
| 5,012,590 A | | 5/1991 | Wagner et al. | |
| 5,031,886 A | | 7/1991 | Sosebee | |
| 5,129,153 A | | 7/1992 | Burns, Sr. | |
| 5,375,381 A | * | 12/1994 | Park et al. | 52/92.1 |
| 5,490,334 A | | 2/1996 | Payne | |
| 5,819,498 A | * | 10/1998 | Geraci | 52/745.1 |
| 5,884,411 A | | 3/1999 | Raber | |
| 5,937,531 A | | 8/1999 | Menk et al. | |
| 6,318,029 B1 | * | 11/2001 | Huppunen | 52/105 |
| 6,385,859 B1 | * | 5/2002 | Varney | 33/613 |
| 6,427,413 B1 | * | 8/2002 | Lafrance | 52/578 |

* cited by examiner

*Primary Examiner*—Carl D. Friedman
*Assistant Examiner*—Jennifer I. Thissell
(74) *Attorney, Agent, or Firm*—Albert J. Dalhuisen

(57) ABSTRACT

The present invention provides devices for positioning frame members for fabricating a wood frame. Each device includes an elongated flexible member and wood blocks that are removably attached to the flexible member. The length of the wood blocks equals the required distance between the frame members. The blocks are separated by slots wherein the frame members are snugly fitted in order to properly position the frame members for fabricating a wood frame structure. The wood blocks can be removed from the device for subsequent use in frame structures, thus reducing lumber waste.

27 Claims, 3 Drawing Sheets

FRAMING LAYOUT TEMPLATE

FIELD OF THE INVENTION

The present invention relates to tools for positioning or spacing of structural members for wood frames that are utilized in the construction of buildings.

BACKGROUND OF THE INVENTION

Wood frames are employed in the construction of buildings such as houses and commercial buildings. These frames typically employ structural members such as pre-shaped wood sections for example studs, joists, rafters and posts to form frames for walls, partitions, floors and roofs. In wood frame construction, spacing of the structural members is based upon standardized modules. This allows efficient use of attached panels whose dimensions are also based upon these modules. Examples of these panels include drywall, also known as gypsum board, sheetrock and plasterboard, and exterior sheathing panels. These panels also provide structural integrity for the building. Commonly available pre-shaped wood sections for use in wood frames include lumber sections having cross sectional dimensions that are known as "two by four", hereinafter referred to as 2×4, having cross sectional dimensions of about 1½ inches and about 3½ inches. Commercially available 2×4 lumber includes 8 foot and 10 foot lengths.

Interior or exterior walls of wood framed constructions typically utilize rectangular frames employing a first horizontal member including a sole plate, also known as a floor plate, having for example a 2×4 cross sectional dimensions and a second horizontal member including a rafter, or top plate. Vertical lumber sections, usually referred to as studs, are fastened at regular intervals between the sole and top plates. Walls requiring additional spacing between the exterior and interior sheathing materials typically employ 2×6 lumber having cross sectional dimensions of about 1½ inches by about 5½ inches. The frame members such as the sole and top plates and the studs need to be spaced appropriately to allow for attaching the edges of commercially available exterior and interior sheathing materials such as 4×8 (4 feet by 8 feet) plywood, sheetrock and paneling. A standardized spacing between frame members is also necessary in order to meet structural requirements such as the load bearing requirements of the frame. In the construction industry studs are often spaced at 16 or 24 inch centers, i.e. the centers of studs are spaced at 16 or 24 inch intervals. However, other stud spaces are also utilized where necessary. Typically, load bearing exterior or interior wood frames have a standardized height such as 8 feet or 10 feet.

Wood framed structures, such as houses, typically require several wood frames that have the same height, for example 8 feet, and the same center-to-center stud spacing. It is customary to pre-fabricate the required wood frames on a horizontal surface such as a floor in order to facilitate the layout and attachment of the pre-shaped sections such as the top and bottom plates and the studs. Desirably, the frames are formed in a manner that results in accurate placement and positioning of the pre-shaped sections, highly economical time and materials usage, and minimal wasted materials.

Examples of prior art techniques and tools for facilitating the desired positioning of pre-shaped wood sections, such as studs, when fabricating wood frames for use in the wood frame structures include the following publications. U.S. Pat. No. 5,937,531 (Menk et al., 1999) discloses a framing tool for spacing frame members, employing cradles that are slidably affixed to a rigid member. Each cradle is adapted for receiving a stud. The studs are positioned by positioning the respective cradles in the desired positions. U.S. Pat. No. 5,490,334 (Payne, 1996) and U.S. Pat. No. 5,129,153 (Burns, Sr., 1992) disclose framing tools having fixed dimensions for spacing or holding adjacent studs in pre-determined positions for attachment to cross members. U.S. Pat. No. 5,031,886 (Sosebee, 1991) and U.S. Pat. No. 4,843,726 (Ward, 1989) disclose jigs for holding studs in pre-determined positions with respect to a cross member to facilitate attachment of the studs to the cross member in properly spaced and aligned positions. U.S. Pat. No. 5,012,590 (Wagner et al., 1991) and U.S. Pat. No. 4,845,858 (Thomas, 1989) disclose tapes having indicia marking the required positions for positioning wood sections, such as studs, in the fabrication of wood frames. These tapes are intended to be left in place within the completed wood frame. U.S. Pat. No. 4,301,596 (Sedlock, 1981) discloses a measuring tape having specially designed measuring scales that can be used to mark the position of the studs on cross members such as sole and top plates.

As is apparent from the prior art publications, a great deal of effort has gone into the design of techniques and tools to provide effective means for spacing pre-shaped wood sections in wood frames. However, notwithstanding these efforts the construction industry continues to search for improved framing techniques and tools in order to assure accurate spacing of frame members, to reduce wood framing time and material costs and to reduce construction material waste.

SUMMARY OF THE INVENTION

The present invention provides novel techniques and devices for positioning wood frame members for the fabrication of wood frames.

In one embodiment of the present invention a device for positioning frame members is provided, including an elongated flexible member having wood blocks removably attached thereto. A slot separates each block from an adjacent block. The length of the wood blocks equals the required distance between the frame members, while each slot is adapted for snugly fitting a frame member therein.

In another embodiment of the present invention a device for positioning frame members is provided, including an elongated flexible member having wood blocks removably attached thereto. A slot separates each block from an adjacent block. Two different slot widths are provided. The slot widths alternate between a first width suitable for snugly fitting a framing member therein, and a second width that is wider than the first width and that includes a mark on the flexible member for positioning a frame member thereon. The length of the wood blocks equals the required distance between the frame members.

In a further embodiment of the present invention a method is provided for positioning frame members for fabricating a wood frame. The method includes determining the thickness of the frame members and determining the required distance between the frame members. The method additionally includes fabricating a device for positioning the frame members, wherein the device comprises an elongated flexible member with removably attached wood blocks separated by slots. The length of the wood blocks equals the required distance between the frame members. The slot width is designed for snugly fitting the frame members therein.

In yet another embodiment of the present invention a method is provided for reducing lumber waste. The method includes employing lumber waste pieces in a device for positioning frame members for fabricating a wood frame. The waste pieces are cut to the required length for the device, i.e. the required distance between adjacent frame members, and are then removably attached to an elongated flexible member. The blocks can be made from used or cleaned lumber stock. The frame members are positioned in slots provided between the blocks of the device. Subsequently, the frame is fabricated and removed from the device. The blocks are then removed from the device and utilized by affixing them to a frame structure.

DETAILED DESCRIPTION OF THE INVENTION

While describing the invention and its embodiments, certain terminology will be utilized for the sake of clarity. It is intended that such terminology include not only the recited embodiments but all equivalents that perform substantially the same function, in substantially the same manner to achieve the same result.

Figure 1:
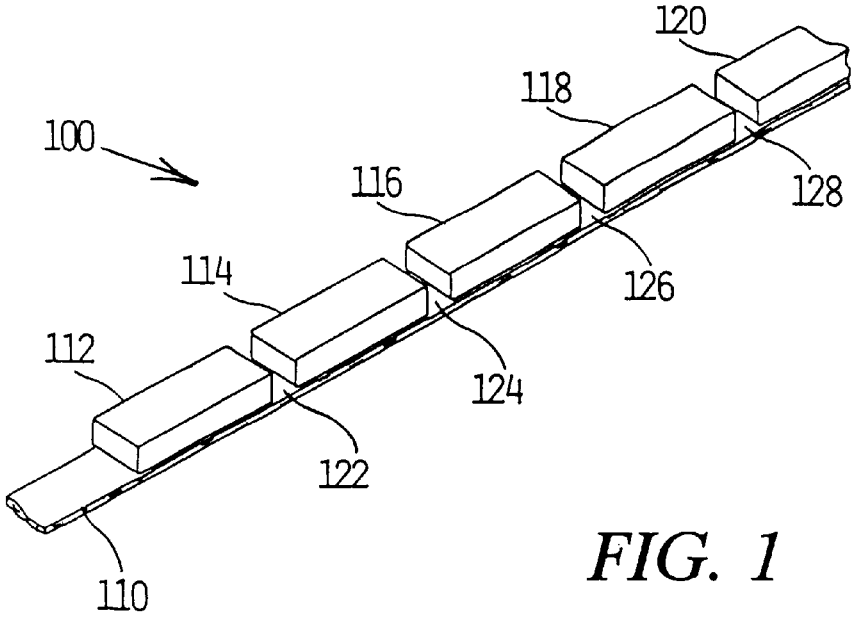
FIG. 1 is a schematic perspective view illustrating a framing layout template strip of the present invention.

In one embodiment of the invention a framing layout template strip 100, shown in FIG. 1, includes an elongated flexible member 110 extending along the entire length of strip 100. Wood blocks 112, 114, 116, 118 and 120 are removably attached to flexible member 110. Slots 122, 124, 126 and 128 are provided between blocks 112, 114, 116, 118 and 120 respectively. Each of the slots 122, 124, 126 and 128 has a pre-determined width to receive frame members including pre-shaped wood sections, for example 2×4 studs, such that the frame members fit snugly in the slots. Suitable materials for flexible member 110 include ribbons, tapes, cloth strips, paper strips, reinforced paper strips, coated paper strips, flexible plastic strips, flexible rubber strips, cords, strings, rope and chains. Preferably, flexible member 110 provides structural stability and integrity in a variety of weather conditions and exhibits little deformation, such as stretching, under the intended use conditions, i.e. conditions of using the strip at a building site.

Suitable materials for blocks 112, 114, 116, 118 and 120 depicted in FIG. 1, include lumber such as is commonly used in the construction of wood framed buildings. Suitable blocks can be prepared from waste lumber as well as used or cleaned lumber stock. Preferably, these blocks are similar in cross sectional dimensions and type of wood as the lumber that is used in the construction of the wood frames for which strip 100 provides the frame layout, as will be more fully described in connection with FIG. 2. The blocks are removably attached to the flexible strip using attachment means that are well known to those of ordinary skill in the art including tacks, nails, staples and adhesives particularly pressure sensitive adhesives (PSA). As is well known to those of ordinary skill in the art, PSA remains somewhat tacky and provides a relatively low bond strength between the adhesive and the substrate to which it is applied, thus resulting in an adhesive bond that is easily broken. Examples of PSA suitable for the present invention are described in U.S. Pat. No. 3,922,464 (Silver et al., 1975), which is herein incorporated by reference. The surface of the block that contacts the flexible member is referred to as the contact surface.

Returning to FIG. 1, the dimensions of blocks 112, 114, 116, 118 and 120 and slots 122, 124, 126 and 128 are adapted for the dimensions of the pre-shaped frame members. For example where the pre-shaped frame members, such as studs, have cross sectional dimensions of 1½×3½ inches and where the studs are positioned on 16 inch centers, each of the slots has an approximate width of 1½ inch and the centers of adjacent slots are 16 inches apart from one another, while the blocks have a length of about 14½ inches. Preferably, the width of the blocks is about 3½ inches. It will be noted that the terms "thickness" and "width" as used herein refer to the smaller and greater cross sectional dimensions respectively. The width and thickness of flexible member 110 are not critical. Preferably, the width of the flexible member is similar to the width of the blocks that are attached to it.

Figure 2:
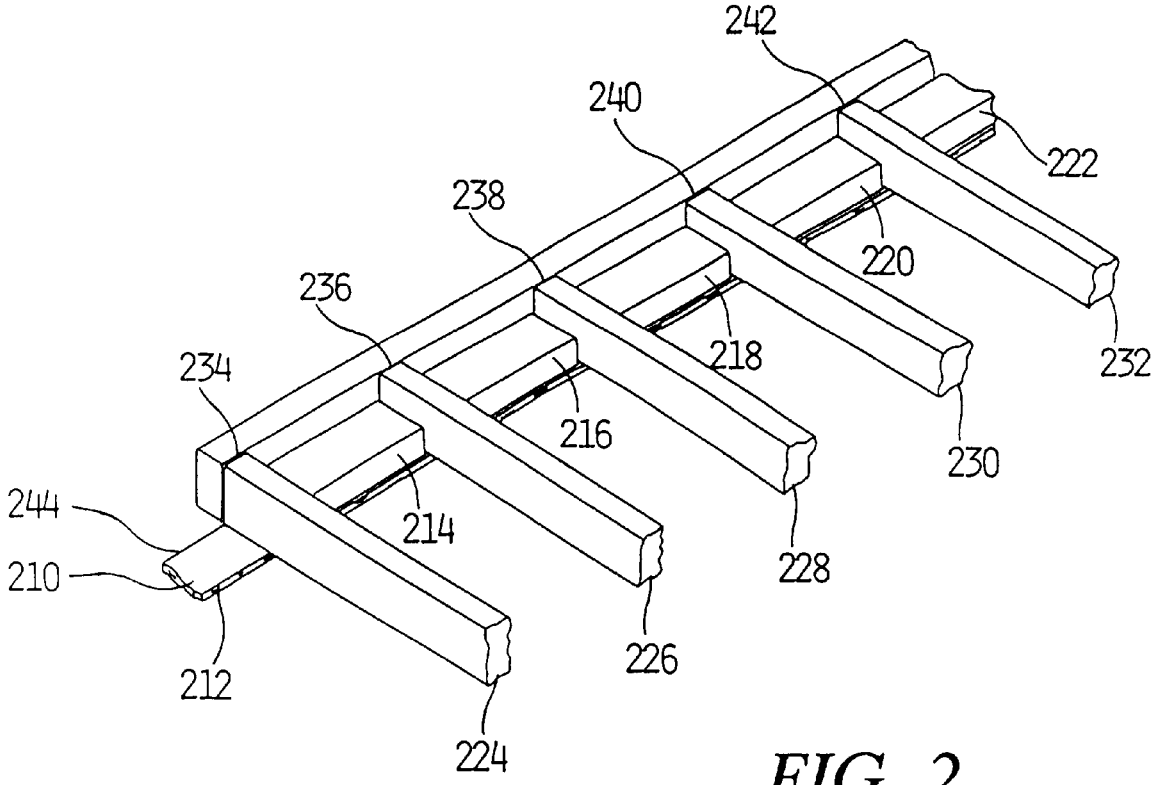
FIG. 2 is a schematic perspective view illustrating the positioning of frame members in a framing layout template strip of the present invention.

FIG. 2 illustrates another embodiment of the present invention wherein pre-shaped frame members are positioned by means of a novel framing layout strip 210, that is similar to strip 100 illustrated in FIG. 1. Returning to FIG. 2, strip 210 includes an elongated flexible member 212 and wood blocks 214, 216, 218, 220 and 222 that are removably attached to flexible member 212. Strip 210 is attached (not shown) to a rigid surface (not shown), for example nailing the strip to a floor (not shown). A pre-shaped wood frame member for example a stud 224 is placed abutting the exposed end of first block 214. A second stud 226 is placed in the slot between blocks 214 and 216. Similarly, studs 228, 230 and 232 are positioned in the slots between blocks 216, 218, 220 and 222 respectively. The studs are then aligned such that ends of the studs are in a substantially straight line, for example by aligning ends 234, 236, 238, 240 and 242 of studs 224, 226, 228, 230 and 232 respectively with exposed side 244 of strip 210. The angle of each of the studs with respect to strip 210 is then adjusted by moving the studs if necessary, to obtain the desired angle. For example, a rectangular frame requires a substantially perpendicular position between the strip and each of the studs. Subsequently, a cross member such as a sole or top plate 234 is positioned abutting ends 234, 236, 238, 240 and 242 of the studs. The cross member is then attached to the ends of the studs using techniques that are well known to those ordinary skill in the art, for example employing nails or screws.

The completed frame is then removed (not shown) from strip 210, shown in FIG. 2. Studs 224, 226, 228, 230 and 232 of the completed frame are thereby accurately positioned at pre-determined intervals, such as at 16 inch centers. Novel framing layout template strip 210 can then be used to fabricate additional wood frames. Framing layout template strip 210 thus forms a device for positioning framing members.

Novel framing layout template strips such as strips 100 (FIG. 1) and 210 (FIG. 2) might need to be replaced with new strips having a different design, for example when subsequent wood frames need to be constructed using dimensions such as the slot widths that are different. Or, these strips may need to be replaced because of damage, making the strip an unreliable template. When the novel framing layout template strips are discarded, the wood blocks can be removed from the strip, since the blocks are removably attached to the flexible member. These blocks can then be utilized in the frame structure of the building, for example as fire stops, strengthening spacers, interior supports for plumbing fixtures and grab bars because the wood blocks have substantially the same length as the spacing between frame members. This unexpected feature reduces construction related lumber waste.

Figure 3:
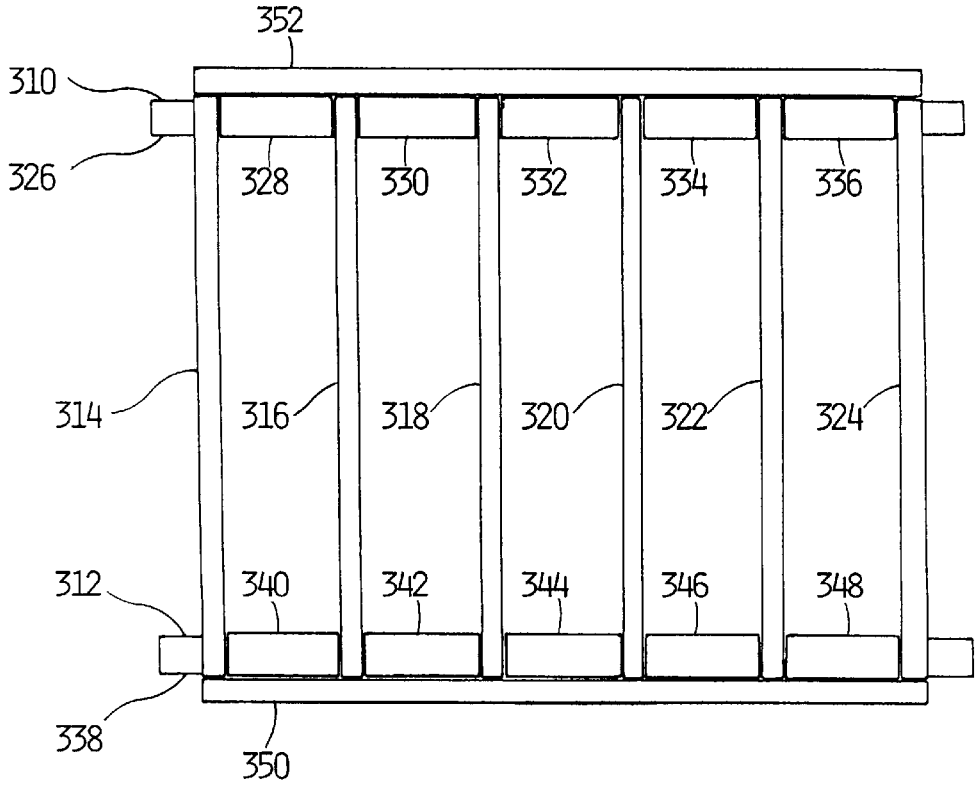
FIG. 3 is a schematic view illustrating the positioning of frame members in two framing layout template strips of the present invention.

In a further embodiment of the present invention, depicted in FIG. 3, novel framing layout template strips 310 and 312 are utilized to position framing members 314, 316, 318, 320, 322 and 324 in pre-determined positions. Strips 310 and 312 are similar to strips 100 and 210 described in connections with FIGS. 1 and 2. Strip 310 includes an elongated flexible member 326 and wood blocks 328, 330, 332, 334 and 336, see FIG. 3. Similarly, strip 312 includes a flexible member 338 and wood blocks 340, 342, 344, 346 and 348. Strips 310 and 312 are attached (not shown) to a rigid surface (not shown). The strips are positioned substantially parallel to each other and such that the resulting frame will be rectangular. A frame member, such as a stud 314, is positioned abutting the exposed ends of blocks 328 of strip 310, and block 340 of strip 312. Similarly, frame member 324 is positioned abutting the exposed ends of blocks 336 and 348 of strips 310 and 312 respectively. One end portion of frame members 316, 318, 320 and 322 is positioned in the slots between blocks 328, 330, 332, 334 and 336 of strip 310, while the other end portion of these frame members is positioned between blocks 340, 342, 344, 346 and 348. Cross members 350 and 352 are positioned at the ends of the frame members as shown in FIG. 3. The cross members are attached to the ends of frame members using attachments means that are well known to those of ordinary skill in the art. The completed frame can then be removed from strips 310 and 312. These strips can subsequently be utilized to fabricate the next frame.

While FIGS. 2 and 3 illustrate the positioning of a cross member adjacent the respective novel frame layout template strip, the invention is equally operable when the ends of the frame members protrude significantly through the respective strip, resulting in a gap between the cross member and the strip.

Novel framing layout template strips 100 (FIG. 1), 210 (FIG. 2), and 310 and 312 (FIG. 3) are provided with slots for snugly fitting the frame members therein. These slots are provided on pre-determined centers such as 16 inches, 24 inches, or combinations of different center spaces. Generally the strips are not provided with marks or indicia to indicate the intended position of the framing members since these positions are determined by the positions of the wood blocks on the flexible member. It is well known that positioning the frame members in slots is less time consuming and generally more accurate than positioning the frame members by means of marks. However, it is also contemplated to provide embodiments of the present invention that include one or more slots for positioning a pre-shaped framing member as well as one or more marks or indicia on the flexible tape for positioning frame members. Such a combination of slots and positioning marks provides novel frame layout template strips wherein one strip can for example be used to position frame members at two different spacings as is illustrated in FIG. 4.

Figure 4:
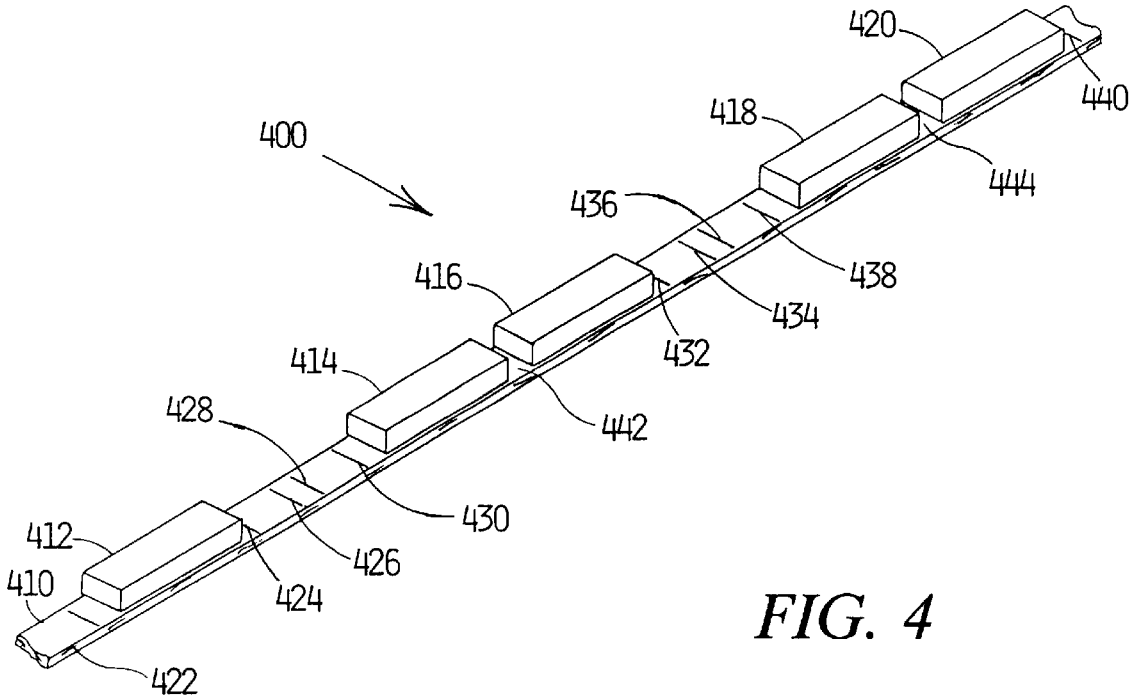
FIG. 4 is a schematic perspective view illustrating another framing layout template strip of the present invention.

Framing layout template strip 400 of the present invention, depicted in FIG. 4, includes an elongated flexible member 410, similar to flexible member 110 of novel framing layout template strip 100 (FIG. 1) and wood blocks 412, 414, 416, 418 and 420 similar to the wood blocks of strip 100, except that the wood blocks of strip 400 are positioned differently from those of strip 100. Novel strip 400 additionally includes frame member positioning marks 422, 424, 426, 428, 430, 432, 434, 436, 438 and 440. These marks or indicia are provided on the flexible member using mark indicators that are well known to those of ordinary skill in the art including pencil, ink, painted marks or scoring marks. The distance between marks 422, 424, 430, 432, 438 and 440 and the nearest wood block is substantially equal to the thickness of the pre-shaped frame member that is to be positioned by means of strip 400. Also, the distance between marks 426 and 428, as well as the distance between marks 434 and 436 is substantially equal to the thickness of the frame member. Slot 442 between blocks 414 and 416 as well as slot 444 between blocks 418 and 420 have widths that are substantially equal to the thickness of the frame member.

Strip 400, illustrated in FIG. 4, can be employed to fabricate frames having 2×4 studs positioned on 16 inch centers as well as 2×4 studs positioned on 24 inch centers as follows. The length of each of the blocks 412, 414, 416, 418 and 420 is approximately 14½ inches. Blocks 412 and 414 are positioned approximately 17½ inches apart. An approximately 1½ inch space between marks 426 and 428 is centered between blocks 412 and 414. Similarly, blocks 416 and 418 are positioned approximately 17½ inches apart, including a 1½ inch space between marks 434 and 436 centered between these two blocks. Novel framing layout template strip 400 can be utilized to provide 16 inch center positioning of 2×4 frame members (not shown) by placing these frame members on the marked spaces between marks 426 and 428 and between marks 434 and 436 as well as adjacent each of the wood blocks and the nearest positioning mark. Also, frame members are positioned in slots 442 and 444 to complete the positioning of 2×4 frame members on 16 inch centers. Strip 400 of the present invention can be employed to provide 24 inch center positioning of 2×4 frame members (not shown) as follows. A first 2×4 frame member is positioned between mark 422 and block 412, a second frame member is positioned between marks 426 and 428, a third frame member in slot 442, a fourth frame member between marks 434 and 436 and a fifth frame member in slot 444.

Figure 5:
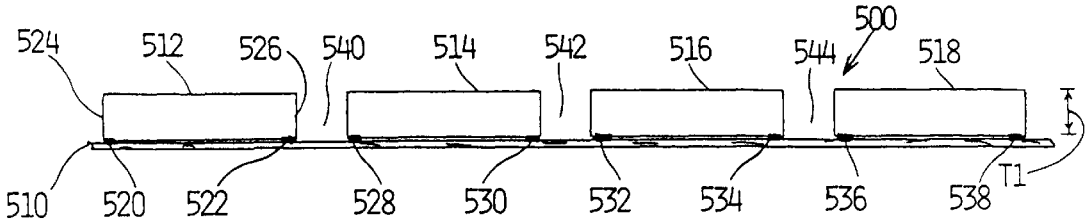
FIG. 5 is a schematic side elevation view illustrating another framing layout template strip of the present invention.

In order to maximize the integrity and dimensional stability of the novel framing layout template strips, it is desirable to removably attach each block across its entire length to the flexible member as is exemplified in FIG. 5. Novel framing layout template strip 500 includes an elongated flexible member 510, similar to flexible member 110 of strip 100 (FIG. 1), and wood blocks 512, 514, 516 and 518 similar to the wood blocks of strip 1. Returning to FIG. 5, wood block 512 is removably attached to flexible member 510 at attachment positions 520 and 522 which are on the side of the block that contacts the flexible member, near or at the end surfaces 524 and 526 respectively, for example where the attachment positions are spaced ¼ inch or less from the adjacent block end. The attachment positions can for example be provided at the corners of the block or across the entire width of the block. In cases where an adhesive is used to provide the removable attachment between the block and the flexible strip, a glue line can be made on the contact surface of the block near the end surfaces of the block. Alternatively, an adhesive such as a PSA can be applied across the entire contact surface of the block. Blocks 514, 516 and 518 are similarly removably attached to flexible member 510 at attachment positions 528, 530, 532, 534, 536 and 538 respectively.

Figure 6:
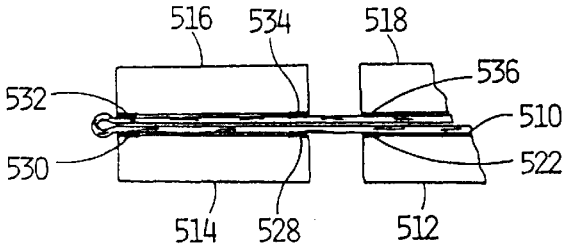
FIG. 6 is a schematic side elevation view showing the strip illustrated in FIG. 5 in a partly folded position.

Desirably, framing layout template strips of embodiments of the present invention are adapted for folding each strip such that each strip segment having a block that is attached to a portion of the flexible member, can be folded or stacked onto another block containing segment of the strip, in order to be able to store or transport each strip in the form of a bundle or stack. A bundle or stack form reduces the likelihood of damage to the novel strip during storage and transportation. However, it was found that a novel strip such as strip 500 (FIG. 5) cannot be folded or stacked in the desired manner when the width of slots 540, 542 and 544 between blocks 512, 514, 516 and 518 is similar to, or less than, the thickness T1 of the blocks, as pictorially illustrated in FIG. 6. The slot width, as defined herein, comprises the distance between adjacent blocks. As shown in FIG. 6, novel strip 500 having a slot width that is approximately equal to the thickness of the wood blocks, can be folded at only one flexible member connection between the wood blocks.

Figure 7:
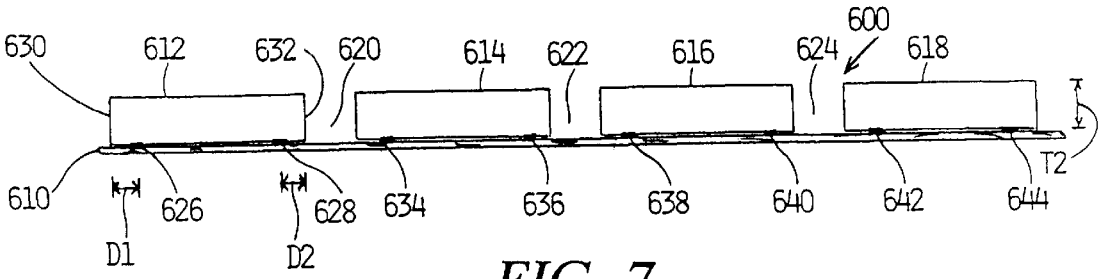
FIG. 7 is a schematic side elevation view illustrating another framing layout template strip of the present invention.

In another embodiment of the present invention, a framing layout template strip 600, shown in FIG. 7, is fabricated such that each strip segment having a block that is attached to a portion of the flexible member, can be folded or stacked onto another block containing strip segment. Strip 600 includes an elongated flexible member 610 similar to flexible member 110 of strip 100, depicted in FIG. 1. Returning to FIG. 7, wood blocks 612, 614, 616 and 618 similar to those described in other embodiments of the invention are removably attached to flexible member 110, providing slots 620, 622 and 624 between these blocks. The width of the slots is substantially equal to thickness T2 of the blocks.

Figure 9:
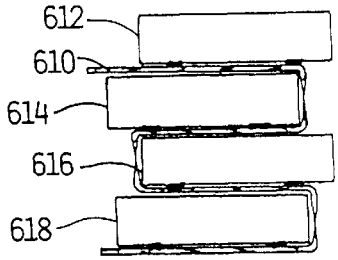
FIG. 9 is a schematic side elevation view showing the strip illustrated in FIG. 8 wherein the strip segments have been folded onto each other.
Figure 8:
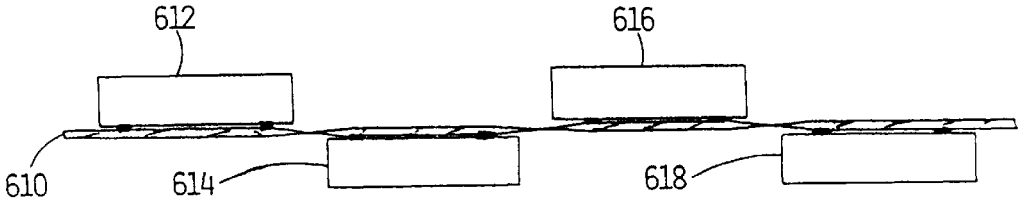
FIG. 8 is a schematic side elevation view showing the strip illustrated in FIG. 7 wherein strip segments have been rotated 180 degrees.

As illustrated in FIG. 7, framing layout template strip 600 includes a block 612 that is attached to flexible member 610 at attachment positions 626 and 628. Attachment position 626 is provided at a pre-determined distance D1 from block end surface 630, while attachment position 628 is provided at a distance D2 from block end surface 632. Similarly, blocks 614, 616 and 618 are provided with attachment positions 634, 636, 638, 640, 642 and 644 respectively. Each of the attachment positions 634 through 644 is thus provided at a pre-determined distance from the adjacent end surface of the wood block. Surprisingly, it was found that novel strip 600 can be folded or stacked where the pre-determined distance, such as D1 and D2, between the attachment position and the adjacent block end surface equals about ¼ T2. In order to stack the strip, each block containing segment of the strip is twisted or rotated about 180 degrees along an axis of rotation approximating the axis of symmetry of flexible member 610, see FIG. 8. The wood block containing segments of strip 600 are then stacked as shown in FIG. 9. It was also found that it is not necessary for distance D1 to equal distance D2 provided that the total distance between attachment positions of adjacent wood blocks equals about 2T2. A similar stacking feature is obtained when the distance between attachment positions of adjacent wood blocks exceeds about 2T2. However, a preferred combination of strip dimensional stability and the ability to stack the wood section containing segments of the strip is obtained when the distance between attachment positions of adjacent wood blocks equals about 2T2, i.e. twice the thickness of the wood block, when the slot width is approximately equal to block thickness T2. It will be understood that a novel strip such as strip 600 can be folded or stacked where the first and/or last attachment positions of the strip (not shown) are provided at the adjacent end surface of the first and/or last blocks respectively. The stacked strip is unfolded or opened prior to positioning the frame members in the slots between the blocks, or on frame member positioning marks as described in connection with framing layout strip 400, shown in FIG. 4.

While exemplary embodiments of framing layout template strips of the present invention include 4 or 5 wood blocks, the invention is equally operable when the number of blocks equals n, and wherein the number of slots between adjacent blocks equals n minus 1.

Framing layout template strips of the present invention can be fabricated by means of several techniques. For example, wood blocks (not shown) can be cut to the desired length and then removably attached to a flexible member (not shown) having marks indicating the attachment positions for the blocks. In another technique, wood blocks (not shown) can be cut to the desired length. These blocks are then placed in a jig (not shown) adapted for temporarily holding the blocks in the desired positions for attachment to a flexible member. The flexible member (not shown) is then placed in contact with the wood blocks and attached to the wood blocks, thereby forming the strip (not shown) that is subsequently removed from the jig.

Framing layout template strips of the present invention, also referred to as devices for positioning framing members, provide a cost effective technique for accurately positioning pre-shaped framing members. Advantageously, the wood blocks of these strips can be salvaged from the strip and can then be used in wood frame construction without additional cutting. Also, the strips employ blocks of lumber such as 2×4, 2×6 and 4×4, generally shorter than 2 feet, thus providing a use for short pieces of lumber that may be discarded by lumber mills and lumber yards as waste, thereby providing a technique for reducing lumber waste.

It is contemplated to provide one or more advertising messages and/or the name of the manufacturer on the novel framing layout template strips, such as strips 100 (FIG. 1), 400 (FIG. 4), 500 (FIG. 5) and 600 (FIG. 6).

The invention has been described in terms of the preferred embodiment. One skilled in the art will recognize that it would be possible to construct the elements of the present invention from a variety of means and to modify the placement of components in a variety of ways. While the embodiments of the invention have been described in detail and shown in the accompanying drawings, it will be evident that various further modifications are possible without departing from the scope of the invention as set forth in the following claims.

We claim:

1. A device for positioning frame members comprising:

a) an elongated flexible member;

b) a number n of wood blocks each having: (1) a pre-determined thickness, (2) a pre-determined width, (3) a pre-determined length, (4) a first end surface, (5) a second end surface opposing the first end surface and (6) a contact surface along the length of the block, for contacting the flexible member and wherein at least a portion of the contact surface of each of the n blocks is removably attached to the flexible member; and c) n minus 1 slots, each slot having a pre-determined slot width adapted for snugly fitting a frame member therein, and wherein (1) each of the n blocks is separated from an adjacent block by one of the n minus 1 slots and (2) each of the n minus 1 slots is adapted for flexing prior to fitting the frame member therein.

2. The device of claim 1 wherein the flexible member is selected from the group consisting of ribbons, tapes, cloth strips, paper strips, reinforced paper strips, coated paper strips, flexible plastic strips, flexible rubber strips, cords, strings, rope and chains.

3. The device of claim 1 wherein each of the n blocks has: (1) substantially the same thickness, (2) substantially the same width and (3) substantially the same length.

4. The device of claim 3 wherein each of the n minus 1 slots have substantially the same slot width, and wherein the frame member has substantially the same thickness as the thickness of the n blocks.

5. The device of claim 4 additionally comprising attachment positions for removably attaching the contact surfaces of the n blocks to the flexible member.

6. The device of claim 5 wherein the attachment positions are provided at a pre-determined distance from the adjacent end surface of each of the n blocks, wherein the pre-determined distance equals approximately half of the block thickness.

7. The device of claim 5 wherein the distance between attachment positions of adjacent blocks is about twice the block thickness.

8. The device of claim 1 wherein the blocks are removably attached to the flexible member employing attachment means selected from the group consisting of tacks, nails, staples and pressure sensitive adhesives.

9. The device of claim 1 additionally comprising a number n of wood block containing strip segments, wherein each segment includes a wood block and a portion of the flexible member that is attached to the block, and wherein each segment is adapted for stacking onto its adjacent segment.

10. The device of claim 1 wherein the wood blocks are additionally adapted for use in a wood frame structure upon removal of the blocks from the device.

11. The device of claim 1 wherein each of the n blocks is removably attached to the flexible member such that the flexible member is not interposed between (1) the n blocks and (2) another rigid surface that is attached to (i) the flexible member and (ii) one or more of the n blocks.

12. The device of claim 1 wherein the frame member comprises:

1) a length exceeding at least the width of the n blocks; and 2) a position of the frame member within the slot such that the length of the frame member is disposed in a plane that is substantially parallel to a plane of the contact surface of at least one of the n blocks that is adjacent to the frame member.

13. The device of claim 9 wherein the elongate member in each of the n minus 1 slots is twisted about 180 degrees along an axis approximating an axis of symmetry of the flexible member that is substantially parallel to the length of at least of the blocks that is adjacent the slot that is twisted.

14. A device for positioning frame members comprising:

a) an elongated flexible member;

b) a number n of wood blocks each having: (1) a pre-determined thickness, (2) a pre-determined width, (3) a pre-determined length and (4) a contact surface along the length of the block, for contacting the flexible member and wherein at least a portion of each of the contact surfaces of the n blocks is removably attached to the flexible member; and c) n minus 1 slots, comprising: (1) first slots that are adapted for snugly fitting a first frame member therein and (2) second slots alternating with the first slots wherein the second slots (i) are wider than the first slots, (ii) include positioning marks therein that are provided on the flexible member, in order to position a second frame member thereon, wherein each of the n blocks is separated from an adjacent block by one of the n minus 1 slots such that each of the n minus 1 slots is adapted for flexing prior to fitting the first and second frame members therein.

15. The device of claim 14 wherein the flexible member is selected from the group consisting of ribbons, tapes, cloth strips, paper strips, reinforced paper strips, coated paper strips, flexible plastic strips, flexible rubber strips, cords, strings, rope and chains.

16. The device of claim 14 wherein each of the n blocks has: (1) substantially the same thickness, (2) substantially the same width and (3) substantially the same length.

17. The device of claim 14 wherein the blocks are removably attached to the flexible member employing attachment means selected from the group consisting of tacks, nails, staples and pressure sensitive adhesives.

18. The device of claim 14 additionally comprising a number n of wood block containing segments, wherein each segment includes a wood block and a portion of the flexible member that is attached to the block along the contact surface, and wherein each segment is adapted for stacking onto its adjacent segment.

19. The device of claim 14 wherein the wood blocks are additionally adapted for use in a wood frame structure upon removal of the blocks from the device.

20. The device of claim 14 additionally comprising:

a) the n wood blocks having a thickness of about 1½ inches;

b) the n wood blocks having a width of about 3½ inches;

c) the n wood blocks having a length of about 14½ inches;

d) the first slots having a width of about 1½ inches between adjacent wood blocks;

e) the second slots having a width of about 17½ inches between adjacent wood blocks; and f) the positioning marks within the second slots marking a space having a width of about 1½ inches.

21. A device for positioning frame members comprising:

a) a first layout strip including: (1) an elongated flexible first member having a contact surface that is positioned in a plane; (2) a number n of wood blocks each having: (i) a pre-determined thickness, (ii) a pre-determined width, (iii) a pre-determined length, (iv) a first end surface, (v) a second end surface opposing the first end surface and (vi) a contact surface along the length of the block for contacting the contact surface of the flexible first member and wherein at least a portion of the contact surface of each of the n blocks is removably attached to the flexible first member, and (3) n minus 1 slots, each slot having a pre-determined slot width adapted for snugly fitting a frame member therein, and wherein each of the n blocks is separated from an adjacent block by one of the n minus 1 slots such that each of the n−1 slots of the first layout strip is adapted for flexing prior to fitting the frame member therein; and b) a second layout strip including: (1) an elongated flexible second member having a contact surface that is positioned in a plane that is substantially the same plane wherein the contact surface of the elongated flexible first member is positioned, (2) a number n of wood blocks having: (i) substantially the same thickness as the n blocks of the first strip, (ii) substantially the same width as the n blocks of the first strip and (iii) substantially the same length as the n blocks of the first strip, wherein each of the n blocks of the second strip are removably attached to the flexible second member, and (3) n minus 1 slots having substantially same the slot width as the pre-determined slot width of the first strip, wherein the first strip is adapted for receiving a first end portion of the frame member and wherein the second strip is adapted for receiving a second end portion of the frame member.

22. A method of positioning frame members for fabricating a wood frame, the method comprising:

a) determining the thickness T of the frame members;

b) determining the required distance D between adjacent frame members;

c) determining the desired number N of frame members for forming the wood frame;

d) fabricating a device for positioning the frame members the device comprising: (1) an elongated flexible member, (2) at least N minus 1 wood blocks having (i) a thickness T, (ii) a pre-determined width and (iii) a length D, wherein each of the at least N minus 1 blocks is removably attached along at least a portion of its length to the flexible member, and (3) a plurality of slots, each slot having a pre-determined width adapted for snugly fitting frame members having the thickness T therein, and wherein each of the at least N minus 1 blocks is separated from an adjacent block by one of the plurality of slots such that each of the plurality of slots is adapted for flexing prior to fitting the frame members therein; and e) positioning the frame members in the plurality of slots.

23. The method of claim 22 additionally comprising:

a) attaching a cross member to each of the frame members, thereby fabricating the wood frame; and b) removing the device from the wood frame.

24. The method of claim 22 additionally comprising:

a) stacking the at least N minus 1 wood blocks of the device after fabricating the device and prior to positioning the frame members by (1) twisting each block about 180 degrees along an axis approximating an axis of symmetry of the flexible member that is substantially parallel to the length of the block that is twisted, and (2) stacking each block on its adjacent block such that a flexible member portion is disposed between adjacent stacked blocks thereby forming a stacked device; and b) unfolding the stacked device prior to positioning the frame members.

25. A method for reducing lumber waste, method comprising:

a) collecting lumber waste pieces having a length equal to or greater than a length D;

b) cutting the lumber pieces to length D, thereby preparing a number n of wood blocks;

c) fabricating a device for positioning frame members having a thickness T and wherein the frame members are spaced a distance D from each other, the device comprising: (1) an elongated flexible member, (2) the n wood blocks removably attached to the flexible member, (3) n−1 slots, each slot having a pre-determined width adapted for snugly fitting the frame members having thickness T therein, and wherein each of the n blocks is separated from an adjacent block by one of the n−1 slots;

d) positioning the frame members in the n−1 slots of the device;

e) fabricating a first wood frame including the frame members that are positioned in the device;

f) removing the first wood frame from the device;

g) removing at least one of the n blocks from the device; and h) affixing the at least one of the n blocks to a second wood frame structure.

26. The method of claim 25 wherein D is about 2 feet.

27. A device for positioning frame members comprising:

a) an elongated flexible member;

b) a number n of wood blocks each having: (1) a pre-determined thickness, (2) a pre-determined width, (3) a pre-determined length, (4) a first end surface, (5) a second end surface opposing the first end surface and (6) a contact surface along the length of the block, for contacting the flexible member and wherein at least a portion of the contact surface of each of the n blocks is removably attached to the flexible member; and c) n minus 1 slots, each slot having a pre-determined slot width adapted for snugly fitting a frame member therein, and wherein each of the n blocks is separated from an adjacent block by one of the n minus 1 slots.

* * * * *